US011117001B2

(12) United States Patent
Ronaghi

(10) Patent No.: US 11,117,001 B2
(45) Date of Patent: Sep. 14, 2021

(54) NASAL AIRFLOW DISRUPTION STRIP

(71) Applicant: Alireza Ronaghi, Toronto (CA)

(72) Inventor: Alireza Ronaghi, Toronto (CA)

( * ) Notice: Subject to any disclaimer, the term of this patent is extended or adjusted under 35 U.S.C. 154(b) by 95 days.

(21) Appl. No.: 16/728,662

(22) Filed: Dec. 27, 2019

(65) Prior Publication Data

US 2021/0196993 A1 Jul. 1, 2021

(51) Int. Cl.
*A62B 23/06* (2006.01)

(52) U.S. Cl.
CPC ..... *A62B 23/06* (2013.01)

(58) Field of Classification Search
CPC .. A62B 7/10; A62B 9/06; A62B 23/06; A62B 23/00; A62B 23/02; A62B 23/025; A41D 13/11; A41D 13/1107; A41D 13/1161; A41D 13/1169; A41D 13/1176
See application file for complete search history.

(56) References Cited

U.S. PATENT DOCUMENTS 4,004,584 A * 1/1977 Geaney ..... A41D 13/1176 128/206.14
4,984,302 A * 1/1991 Lincoln ..... A41D 13/1176 128/204.12
5,392,773 A * 2/1995 Bertrand ..... A41D 13/1176 128/206.11
D402,418 S 12/1998 Mibus
7,004,165 B1 2/2006 Salcido
7,263,996 B2 9/2007 Yung Ho
7,878,197 B2 2/2011 Christy
2002/0166556 A1 11/2002 Jacob
2004/0089303 A1* 5/2004 Chien ..... A61F 5/08 128/206.11
2004/0194784 A1* 10/2004 Bertrand ..... A62B 23/06 128/206.18
2008/0223371 A1 9/2008 Guillory
2009/0050144 A1* 2/2009 Pierce ..... A61F 5/56 128/200.24
2009/0194107 A1* 8/2009 Loeser ..... A62B 23/06 128/204.11
2011/0023872 A1 2/2011 Evans
2017/0157437 A1* 6/2017 Krespi ..... A62B 23/06
2018/0221618 A1* 8/2018 Strauss ..... A62B 23/06

FOREIGN PATENT DOCUMENTS

WO WO2005002675 1/2005
WO WO2007092634 8/2007

* cited by examiner

*Primary Examiner* — Colin W Stuart

(57) ABSTRACT

A nasal airflow disruption strip for deflecting inhaled air to reduce nasal irritation includes a strip. The strip comprised of a flexible material. The strip has an inner surface, an outer surface, and a perimeter edge extending between the inner surface and the outer surface. The perimeter edge has a front edge, a rear edge, a first lateral edge, and a second lateral edge. An adhesive is positioned on and covers the inner surface. The adhesive removably secures the inner surface to an underside of a person's nose such that nostrils of the nose are covered. The strip includes at least one air permeable section and at least one air impermeable section. The air permeable section is alignable with the nostrils. The air permeable section is positioned adjacent to the rear edge.

8 Claims, 4 Drawing Sheets

NASAL AIRFLOW DISRUPTION STRIP

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to nasal strip devices and more particularly pertains to a new nasal strip device for deflecting inhaled air to reduce nasal irritation. Inhaled irritants can cause discomfort to a person when they contact the nasal cavity. The nasal cavity is structured such that inhaled air is turbulated to aid the sense of smell. This turbulation also ensures that irritants are brought to the olfactory receptors and the olfactory bulb. By altering the flow of inhaled air, the turbulation can be reduced to reduce the number of irritants introduced to the olfactory receptors and the olfactory bulb.

(2) Description of Related Art Including Information Disclosed Under 37 CFR 1.97 and 1.98

The prior art relates to nasal strip devices. The previous disclosures illustrating a variety of methods for filtering inhaled air, or for shutting the nostril openings to prevent inhalation of foreign debris. The previous disclosures are silent on redirecting inhaled air to reduce the irritation caused by any inhaled foreign debris.

BRIEF SUMMARY OF THE INVENTION

An embodiment of the disclosure meets the needs presented above by generally comprising a strip. The strip comprised of a flexible material. The strip has an inner surface, an outer surface, and a perimeter edge extending between the inner surface and the outer surface. The perimeter edge has a front edge, a rear edge, a first lateral edge, and a second lateral edge. An adhesive is positioned on and covers the inner surface. The adhesive is configured to removably secure the inner surface to an underside of a person's nose such that nostrils of the nose are covered. The strip includes at least one air permeable section and at least one air impermeable section. The air permeable section is alignable with the nostrils. The air permeable section is positioned adjacent to the rear edge.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
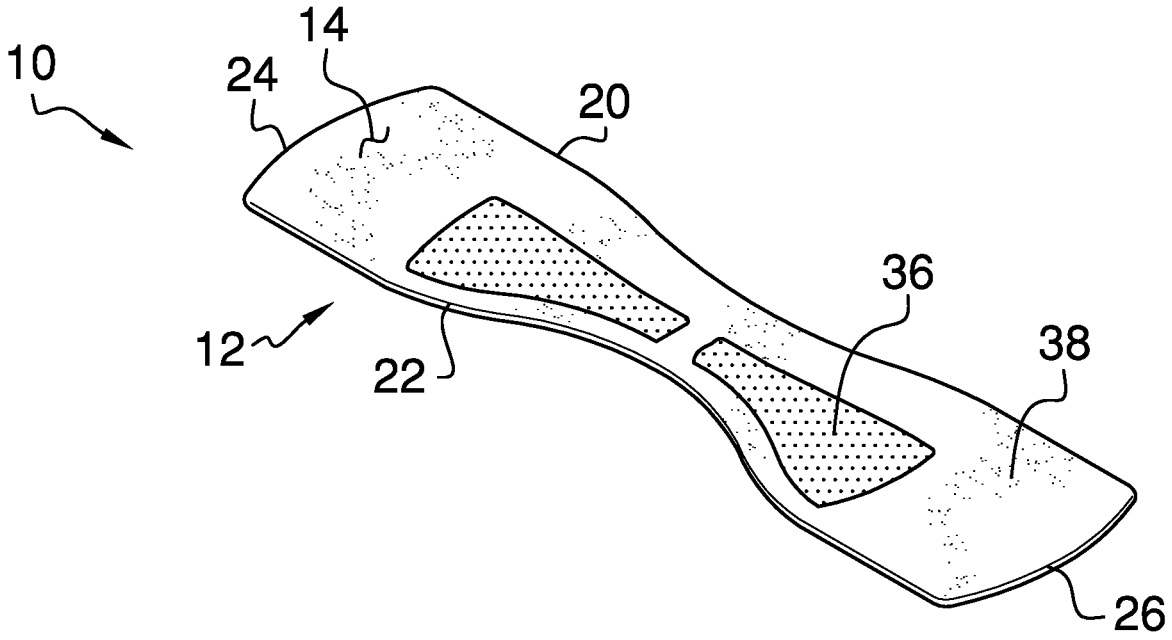
FIG. 1 is an inner surface isometric view of a nasal airflow disruption strip according to an embodiment of the disclosure.
Figure 2:
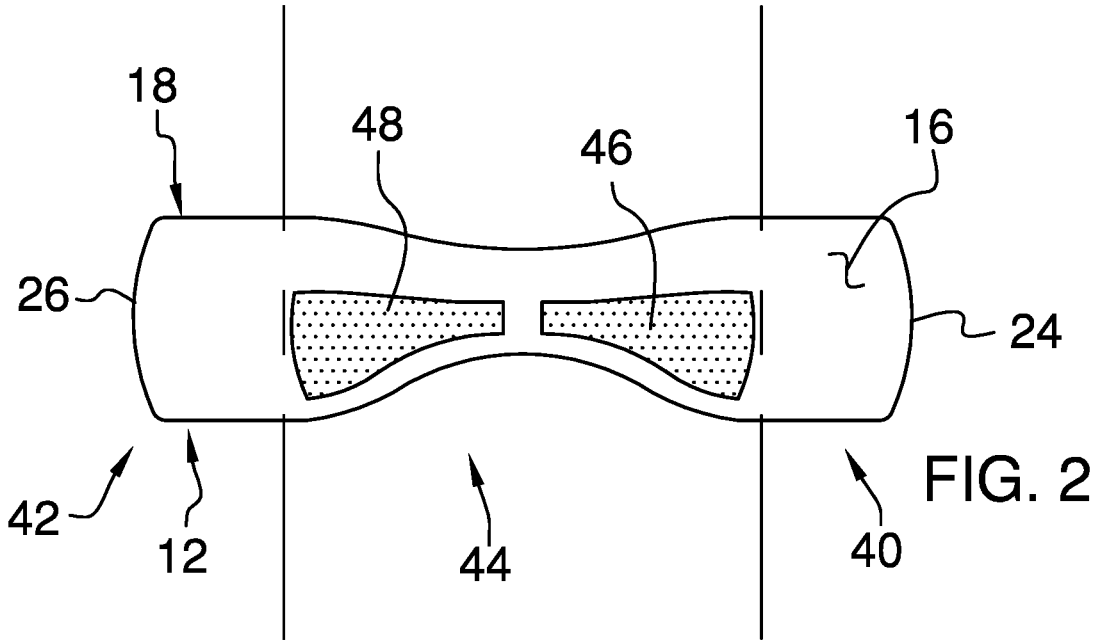
FIG. 2 is an outer surface side view of an embodiment of the disclosure.
Figure 3:
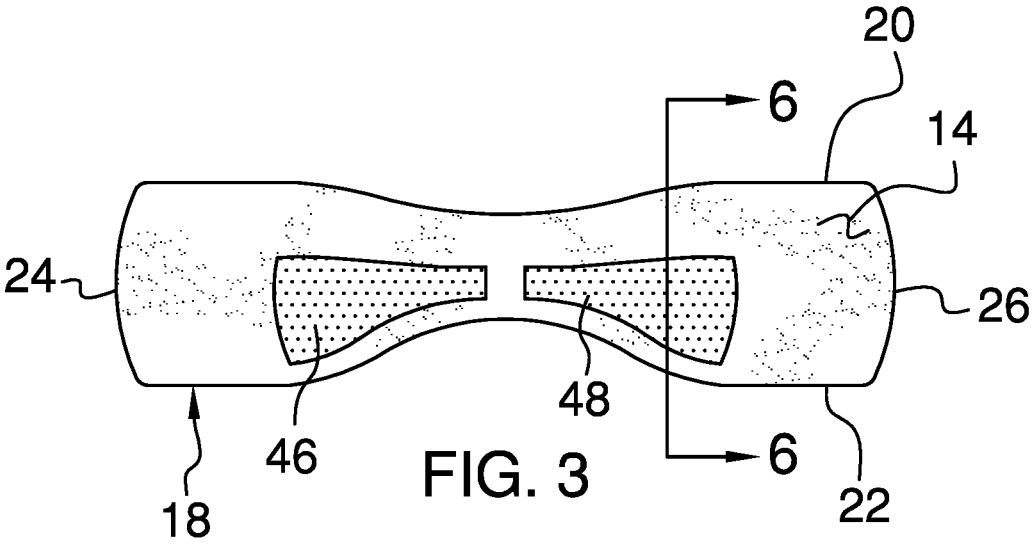
FIG. 3 is an inner surface side view of an embodiment of the disclosure.
Figure 4:
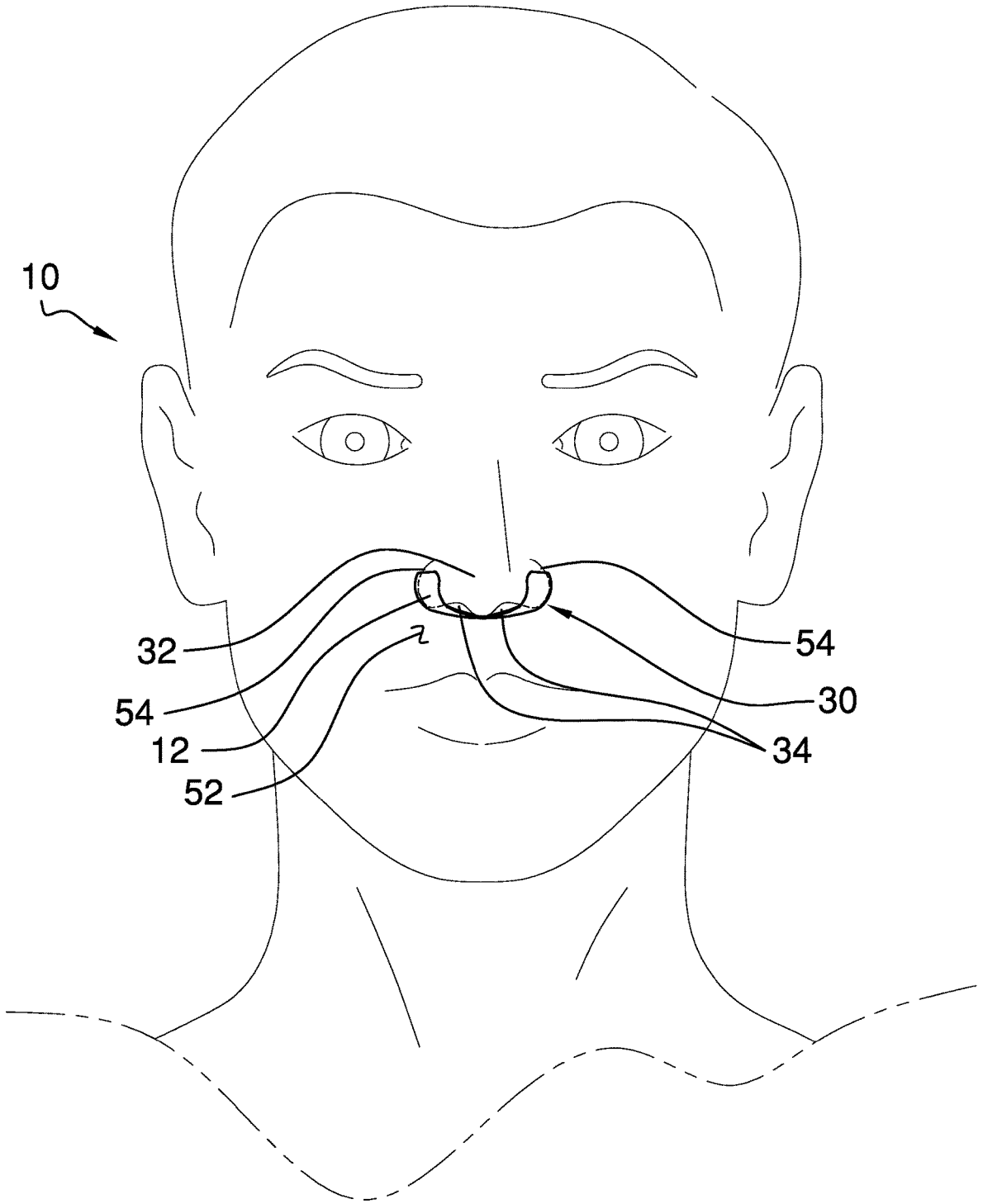
FIG. 4 is an in-use view of an embodiment of the disclosure.

With reference now to the drawings, and in particular to FIGS. 1 through 6 thereof, a new nasal strip device embodying the principles and concepts of an embodiment of the disclosure and generally designated by the reference numeral 10 will be described.

As best illustrated in FIGS. 1 through 6, the nasal airflow disruption strip 10 generally comprises a strip 12 comprised of a flexible material. The strip 12 has an inner surface 14, an outer surface 16, and a perimeter edge 18 extending between the inner surface 14 and the outer surface 16. The perimeter edge 18 has a front edge 20, a rear edge 22, a first lateral edge 24, and a second lateral edge 26. An adhesive 28 is positioned on and covers the inner surface 14 the adhesive 28 is configured to removably secure the inner surface 14 to an underside 30 of a person's nose 32 such that nostrils 34 of the nose 32 are covered. The flexible material used to fabricate the strip 12 may be comprised of natural and synthetic fibers woven together, elastomeric materials, and/or other conventionally available materials.

The strip 12 includes at least one air permeable section 36 and at least one air impermeable section 38. The air permeable section 36 is alignable with the nostrils 34. The air permeable section 36 and air impermeable section 38 are positioned to interact with air inhaled through the nostrils 34 and to disrupt and alter the typical air flow. Typical inhalations experience turbulence from structures within the nasal cavity to increase exposure of the inhaled air to the olfactory receptors and the olfactory bulb. The air permeable section 36 and air impermeable section 38 each interact with the inhaled air to disrupt the turbulence created to reduce the exposure of irritants to the olfactory receptors and the olfactory bulb. By reducing some of the exposure to the olfactory receptors and the olfactory bulb, fewer of any irritants found in the inhaled air will irritate the nasal cavity. Potential irritants may include natural and synthetic chemical particulates, allergens, and other airborne contaminates. By reducing the irritation, a user will experience reduced symptoms of irritation which may include tearing of the eyes, runny nose, or other physical reactions to nasal cavity irritation.

The strip 12 includes a first portion 40 including the first lateral edge 24, a second portion 42 including the second lateral edge 26, and a central portion 44 positioned between the first portion 40 and the second portion 42. The first portion 40 and the second portion 42 have a greater width from the front edge 20 to the rear edge 22 than a width of the central portion 44. The rear edge 22 of the central portion 44 has a concavely arcuate shape. The front edge 20 of the central portion 44 may also have a concavely arcuate shape having a larger radius than the concavely arcuate shape found on the rear edge 22. Each of the first portion 40 and the second portion 42 has a same shape with respect to each other. The first portion 40 and the second portion 42 each extends away from the central portion 44 a distance between 15 mm and 30 mm apart. The first portion 40 and the second portion 42 are spaced from each other a distance between 35 mm and 50 mm apart.

FIG. 1 illustrates an embodiment wherein the air permeable section 36 is positioned adjacent to the rear edge 22 and contained within the central portion 44. The illustrated embodiment has the air permeable section 36 divided into a first section 46 and a second section 48 spaced laterally from each other. The first section 46 and the second section 48 each has an increasing width as the first section 46 and the second section 48 extend toward an adjacent one of the first lateral edge 24 and the second lateral edge 26. All areas of the strip 12 outside of the first section 46 and the second section 48 is air impermeable.

Figure 5:
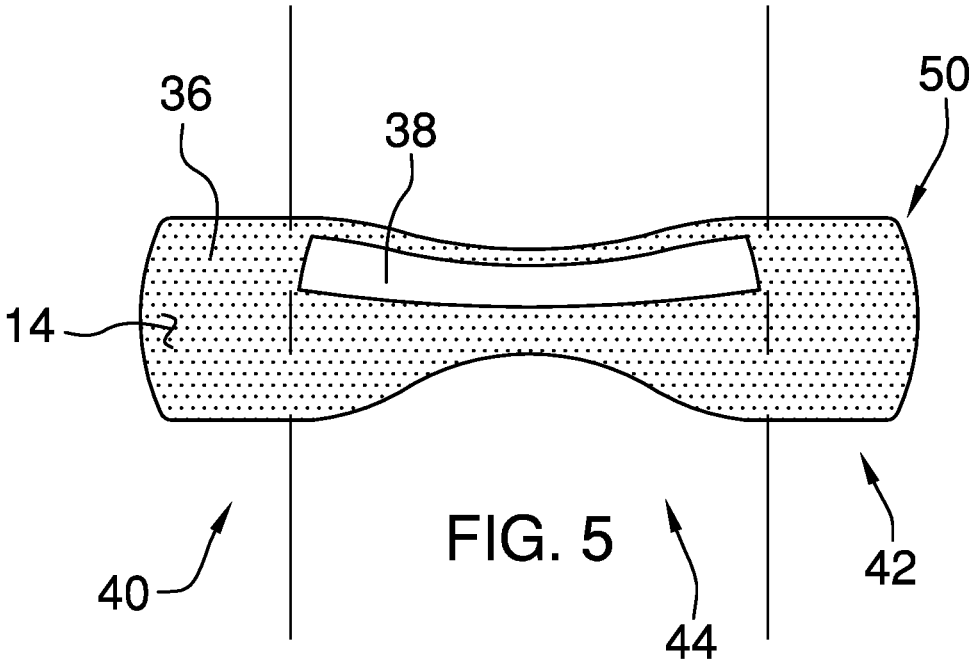
FIG. 5 is an inner surface side view of an alternative embodiment of the disclosure.
Figure 6:
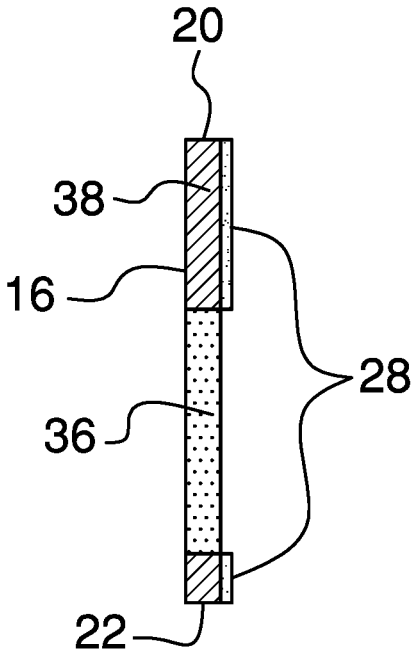
FIG. 6 is a cross-sectional view of an embodiment of the disclosure taken along line 6-6 in FIG. 3.

FIG. 5 illustrates an alternative embodiment 50 wherein the air impermeable section 38 is positioned adjacent to the front edge 20. The alternative embodiment 50 has the air impermeable section 38 positioned spaced from the rear edge 22 and contained within the central portion 44. The alternative embodiment 50 has the remainder of the strip 12 outside the air impermeable section 38 being air permeable.

In use, the strip 12 is removably secured to the underside 30 of the person's nose 32 such that the nostrils 34 of the nose 32 are covered. The inner surface 14 is in contact with the underside 30 of the person's nose 32 with the rear edge 22 positioned adjacent to the person's upper lip 52. The first lateral edge 24 and the second lateral edge 26 are each removably attached to an adjacent one of a pair of outer surfaces 54 of each nostril 34. After use the strip 12 is removed and discarded.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A nasal opening cover assembly configured to disrupt a flow of inhaled air, said assembly comprising:

a strip comprising a flexible material having an inner surface, an outer surface, and a perimeter edge extending between said inner surface and said outer surface, said perimeter edge having a front edge, a rear edge, a first lateral edge, and a second lateral edge, an adhesive being positioned on and covering said inner surface, said adhesive being configured to removably secure said inner surface to an underside of a person's nose such that nostrils of the nose are covered;

said strip including at least one air permeable section and at least one air impermeable section, said at least one air permeable section being alienable with the nostrils;

said at least one air permeable section being positioned adjacent to said rear edge, wherein said at least one air impermeable section is positioned adjacent to said front edge, wherein said at least one air impermeable section is centrally positioned between said first lateral edge and said second lateral edge and is spaced from said rear edge, wherein a remainder of said strip outside of said at least one air impermeable section is air permeable.

2. The nasal opening cover assembly according to claim 1, wherein said strip includes a first portion including said first lateral edge, a second portion including said second lateral edge, and a central portion positioned between said first portion and said second portion, said first portion and said second portion each having a greater width from said front edge to said rear edge than a width of said central portion.

3. The nasal opening cover assembly according to claim 2, wherein said rear edge of said central portion has a concavely arcuate shape.

4. The nasal opening cover assembly according to claim 2, wherein each of said first and second portions has a same shape with respect to each other.

5. The nasal opening cover assembly according to claim 2, wherein said first portion and said second portion each extends away from said central portion a distance between 15 mm and 30 mm, said first and second portions being spaced from each other a distance between 35 mm and 50 mm apart.

6. The nasal opening cover assembly according to claim 1, wherein said at least one air permeable section is divided into a first section and a second section spaced laterally from each other.

7. The nasal opening cover assembly according to claim 6, wherein said first and second sections have an increasing width as said first and second sections extend toward an adjacent one of said first and second lateral edges.

8. A nasal opening cover assembly configured to disrupt a flow of inhaled air, said assembly comprising:

a strip comprising a flexible material having an inner surface, an outer surface, and a perimeter edge extending between said inner surface and said outer surface, said perimeter edge having a front edge, a rear edge, a first lateral edge, and a second lateral edge, an adhesive being positioned on and covering said inner surface, said adhesive being configured to removably secure said inner surface to an underside of a person's nose such that nostrils of the nose are covered;

said strip including at least one air permeable section and at least one air impermeable section, said at least one air permeable section being alienable with the nostrils;

said strip including a first portion including said first lateral edge, a second portion including said second lateral edge, and a central portion positioned between said first portion and said second portion, said first portion and said second portion having a greater width from said front edge to said rear edge than a width of said central portion, said rear edge of said central portion having a concavely arcuate shape, each of said first and second portions having a same shape with respect to each other, said first portion and said second portion each extending away from said central portion a distance between 15 mm and 30 mm, said first and second portions being spaced from each other a distance between 35 mm and 50 mm apart; and said at least one air permeable section being positioned adjacent to said rear edge, said at least one air permeable section being contained within said central portion, said at least one air permeable section being divided into a first section and a second section spaced laterally from each other, said first and second sections each having an increasing width as said first and second sections extend toward an adjacent one of said first and second lateral edges, all areas of said strip outside of said first and second sections being air impermeable.

* * * * *